US006360453B1

(12) United States Patent
Ellis, III

(10) Patent No.: US 6,360,453 B1
(45) **Date of Patent: *Mar. 26, 2002**

(54) CORRECTIVE SHOE SOLE STRUCTURES USING A CONTOUR GREATER THAN THE THEORETICALLY IDEAL STABILITY PLAN

(75) Inventor: Frampton E. Ellis, III, Arlington, VA (US)

(73) Assignee: Anatomic Research, Inc., Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/452,490

(22) Filed: May 30, 1995

Related U.S. Application Data

(63) Continuation of application No. 08/142,120, filed on Oct. 28, 1996, now abandoned, which is a continuation of application No. 07/830,747, filed on Feb. 7, 1992, now abandoned, which is a continuation of application No. 07/416,478, filed on Oct. 3, 1989, now abandoned.

(51) Int. Cl.[7] ..... A43B 13/14

(52) U.S. Cl. ..... 36/25 R; 36/30 VR; 36/31; 36/88; 36/114

(58) Field of Search ..... 36/32 R, 25 R, 36/30 R, 31, 114, 88, 91, 28, 163, 116, 11.5, 11

(56) References Cited

U.S. PATENT DOCUMENTS

| | | | |
|---|---|---|---|
| 288,127 | A | 11/1883 | Shepard |
| 532,429 | A | 1/1895 | Rogers |
| 1,283,335 | A | 10/1918 | Shillcock |
| 1,289,106 | A | 12/1918 | Bullock |
| 1,458,446 | A | 6/1923 | Shaeffer |
| 1,622,860 | A | 3/1927 | Cutler |
| 1,639,381 | A | 8/1927 | Manelas |

(List continued on next page.)

FOREIGN PATENT DOCUMENTS

| | | |
|---|---|---|
| AT | 200963 | 5/1958 |
| CA | 1 138 194 | 12/1982 |
| CA | 1 176 458 | 10/1984 |
| DE | B 23257 | 5/1956 |
| DE | B 23257 VII/71a | 5/1956 |
| DE | 1 888 119 | 12/1963 |
| DE | 287 477 | 1/1969 |
| DE | 1290844 | 3/1969 |
| DE | 1 685 260 | 10/1971 |
| DE | 27 06 645 | 8/1978 |
| DE | 27 37 765 | 3/1979 |
| DE | 28 05 426 | 8/1979 |
| DE | 30 24 587 A1 | 1/1982 |
| DE | 35 45 182 | 5/1983 |
| DE | 33 17 462 | 10/1983 |

(List continued on next page.)

OTHER PUBLICATIONS

Benno M. Nigg and M. Morloc, "The Influence of Lateral Heel Flare of Running Shoes on Pronation of Impact Forces", Medicine and Science in Sports and Exercise. vol. 19, No. 3 (1987), pp. 294–302.

Peter Cavanagh, "The Running Shoe Book", pp. 168–170.

The Reebok Lineup Fall 1987 (2 pages).

German description of adidas badminton shoes, pre–1989(?).

Originally filed Specification for U.S. Pat. application No. 09/522,174 filed Mar. 9, 2000 (ELL–002.5).

(List continued on next page.)

*Primary Examiner*—Anthony Stashick

(74) *Attorney, Agent, or Firm*—Finnegan, Henderson, Farabow, Garrett & Dunner, L.L.C.

(57) ABSTRACT

A shoe having a sole contour which follows a theoretically ideal stability plane as a basic concept, but which deviates outwardly therefrom to provide greater than natural stability. Thickness variations outwardly from the stability plane are disclosed, along with density variations to achieve a similar greater than natural stability.

69 Claims, 8 Drawing Sheets

U.S. PATENT DOCUMENTS

| | | | | | |
|---|---|---|---|---|---|
| 1,701,260 | A | | 2/1929 | Fischer | |
| 1,735,986 | A | | 11/1929 | Wray | |
| 1,853,034 | A | | 4/1932 | Bradley | |
| 2,120,987 | A | | 6/1938 | Murray | |
| 2,147,197 | A | | 2/1939 | Glidden | |
| 2,155,166 | A | | 4/1939 | Kraft | |
| 2,170,652 | A | | 8/1939 | Brennan | |
| 2,179,942 | A | | 11/1939 | Lyne | |
| 2,328,242 | A | | 8/1943 | Witherill | |
| 2,433,329 | A | | 12/1947 | Adler et al. | |
| 2,434,770 | A | | 1/1948 | Lutey | |
| 2,627,675 | A | | 2/1953 | Hack | |
| 2,718,715 | A | | 9/1955 | Spilman | |
| 2,814,133 | A | | 11/1957 | Herbst | |
| 3,100,354 | A | | 8/1963 | Lombard et al. | |
| 3,110,971 | A | | 11/1963 | Chang | |
| 3,305,947 | A | | 2/1967 | Kalsoy | |
| 3,308,560 | A | | 3/1967 | Jones | |
| 3,416,174 | A | | 12/1968 | Novitske | |
| 3,512,274 | A | | 5/1970 | McGrath | |
| 3,535,799 | A | | 10/1970 | Onitsuka | |
| 3,806,974 | A | | 4/1974 | Di Paolo | |
| 3,824,716 | A | | 7/1974 | Di Paolo | |
| 3,863,366 | A | | 2/1975 | Auberry et al. | |
| 3,958,291 | A | | 5/1976 | Spier | |
| 3,964,181 | A | | 6/1976 | Holcombe, Jr. | |
| 3,997,948 | A | | 12/1976 | Hayward | |
| 4,003,145 | A | | 1/1977 | Liebscher et al. | |
| 4,030,213 | A | | 6/1977 | Daswick | |
| 4,068,395 | A | | 1/1978 | Senter | |
| 4,083,125 | A | | 4/1978 | Benseler et al. | |
| 4,096,649 | A | | 6/1978 | Saurwein | |
| 4,098,011 | A | | 7/1978 | Bowrman et al. | |
| 4,128,951 | A | | 12/1978 | Tansill | |
| 4,141,158 | A | | 2/1979 | Benseler et al. | |
| 4,145,785 | A | | 3/1979 | Lacey | |
| 4,149,324 | A | | 4/1979 | Lesser et al. | |
| 4,161,828 | A | | 7/1979 | Benseler et al. | |
| 4,161,829 | A | | 7/1979 | Wayser | |
| 4,170,078 | A | | 10/1979 | Moss | |
| 4,183,156 | A | | 1/1980 | Rudy | |
| 4,194,310 | A | | 3/1980 | Bowerman | |
| 4,217,705 | A | | 8/1980 | Donzis | |
| 4,219,945 | A | | 9/1980 | Rudy | |
| 4,223,457 | A | | 9/1980 | Borgeas | |
| 4,227,320 | A | | 10/1980 | Borgeas | |
| 4,235,026 | A | | 11/1980 | Plagenhoef | |
| 4,240,214 | A | | 12/1980 | Sigle et al. | |
| 4,241,523 | A | | 12/1980 | Daswick | |
| 4,245,406 | A | | 1/1981 | Landay et al. | |
| 4,250,638 | A | | 2/1981 | Linnemann | |
| 4,258,480 | A | | 3/1981 | Famolare, Jr. | |
| 4,259,792 | A | | 4/1981 | Halbrestadt | |
| 4,262,433 | A | | 4/1981 | Hagg et al. | |
| 4,263,728 | A | | 4/1981 | Frecentese | |
| 4,266,349 | A | | 5/1981 | Schmohl | |
| 4,268,980 | A | | 5/1981 | Gudas | |
| 4,271,606 | A | | 6/1981 | Rudy | |
| 4,272,858 | A | | 6/1981 | Hlustik | |
| 4,274,211 | A | | 6/1981 | Funck | |
| 4,297,797 | A | | 11/1981 | Meyers | |
| 4,302,892 | A | * | 12/1981 | Adamik | 36/31 |
| 4,305,212 | A | | 12/1981 | Coomer | |
| 4,308,671 | A | | 1/1982 | Bretschneider | |
| 4,309,832 | A | | 1/1982 | Hunt | |
| 4,316,332 | A | | 2/1982 | Giese et al. | |
| 4,316,335 | A | | 2/1982 | Giese et al. | |
| 4,319,412 | A | | 3/1982 | Muller et al. | |
| 4,322,895 | A | | 4/1982 | Hockerson | |
| 4,335,529 | A | | 6/1982 | Badalamenti | |
| 4,340,626 | A | | 7/1982 | Rudy | |
| 4,342,161 | A | | 8/1982 | Schmohl | |
| 4,348,821 | A | | 9/1982 | Daswick | |
| 4,354,319 | A | | 10/1982 | Block et al. | |
| 4,361,971 | A | | 12/1982 | Bowerman | |
| 4,366,634 | A | | 1/1983 | Giese et al. | |
| 4,370,817 | A | | 2/1983 | Ratanangsu | |
| 4,372,059 | A | | 2/1983 | Ambrose | |
| 4,398,357 | A | | 8/1983 | Batra | |
| 4,399,630 | A | | 8/1983 | Funck | |
| 4,449,306 | A | | 5/1984 | Cavanagh | |
| 4,451,994 | A | | 6/1984 | Fowler | |
| 4,454,662 | A | | 6/1984 | Stubblefield | |
| 4,455,765 | A | | 6/1984 | Sjöswärd | |
| 4,455,767 | A | | 6/1984 | Bergmans | |
| 4,468,870 | A | | 9/1984 | Sternberg | |
| 4,484,397 | A | | 11/1984 | Curley, Jr. | |
| 4,494,321 | A | * | 1/1985 | Lawlor | 36/28 |
| 4,505,055 | A | | 3/1985 | Bergmans | |
| 4,506,462 | A | | 3/1985 | Cavanagh | |
| 4,521,979 | A | | 6/1985 | Blaser | |
| 4,527,345 | A | | 7/1985 | Lopez | |
| 4,542,598 | A | | 9/1985 | Misevich et al. | |
| 4,546,559 | A | | 10/1985 | Dassler | |
| 4,557,059 | A | | 12/1985 | Misevich et al. | |
| 4,559,723 | A | | 12/1985 | Hamy et al. | |
| 4,559,724 | A | | 12/1985 | Norton | |
| 4,561,195 | A | | 12/1985 | Onoda et al. | |
| 4,577,417 | A | | 3/1986 | Cole | |
| 4,578,882 | A | | 4/1986 | Talarico, III | |
| 4,580,359 | A | | 4/1986 | Kurrash et al. | |
| 4,624,061 | A | | 11/1986 | Wezel et al. | |
| 4,624,062 | A | | 11/1986 | Autry | |
| 4,641,438 | A | | 2/1987 | Laird et al. | |
| 4,642,917 | A | | 2/1987 | Ungar | |
| 4,651,445 | A | | 3/1987 | Hannibal | |
| 4,670,995 | A | | 6/1987 | Huang | |
| 4,676,010 | A | | 6/1987 | Cheskin | |
| 4,694,591 | A | | 9/1987 | Banich et al. | |
| 4,697,361 | A | | 10/1987 | Ganter et al. | |
| D293,275 | S | | 12/1987 | Bua | |
| 4,715,133 | A | | 12/1987 | Hartjes et al. | |
| 4,724,622 | A | | 2/1988 | Mills | |
| D294,425 | S | | 3/1988 | Le | |
| 4,727,660 | A | | 3/1988 | Bernhard | |
| 4,730,402 | A | * | 3/1988 | Norton et al. | 36/30 R |
| 4,731,939 | A | * | 3/1988 | Parracho et al. | 36/31 |
| 4,747,220 | A | | 5/1988 | Autry et al. | |
| D296,149 | S | | 6/1988 | Diaz | |
| D296,152 | S | | 6/1988 | Selbiger | |
| 4,748,753 | A | | 6/1988 | Ju | |
| 4,754,561 | A | | 7/1988 | Dufour | |
| 4,756,098 | A | | 7/1988 | Boggia | |
| 4,757,620 | A | | 7/1988 | Tiitola | |
| 4,759,136 | A | * | 7/1988 | Stewart et al. | 36/31 |
| 4,768,295 | A | | 9/1988 | Ito | |
| 4,785,557 | A | * | 11/1988 | Kelley et al. | 36/31 |
| 4,817,304 | A | | 4/1989 | Parker et al. | |
| 4,827,631 | A | | 5/1989 | Thornton | |
| 4,833,795 | A | | 5/1989 | Diaz | |
| 4,837,949 | A | | 6/1989 | Dufour | |
| 4,854,057 | A | | 8/1989 | Misevich et al. | |
| 4,858,340 | A | * | 8/1989 | Pasternak | 36/88 |
| 4,866,861 | A | | 9/1989 | Noone | |
| 4,876,807 | A | | 10/1989 | Tiitola et al. | |
| 4,890,398 | A | | 1/1990 | Thomasson | |
| 4,906,502 | A | | 3/1990 | Rudy | |
| 4,922,631 | A | | 5/1990 | Anderie | |
| 4,934,070 | A | | 6/1990 | Mauger | |
| 4,934,073 | A | | 6/1990 | Robinson | |
| 4,947,560 | A | | 8/1990 | Fuerst et al. | |
| 4,949,476 | A | | 8/1990 | Anderie | |
| 4,982,737 | A | | 1/1991 | Guttman | |
| 4,989,349 | A | * | 2/1991 | Ellis, III | 36/25 R |
| D315,634 | S | | 3/1991 | Yung-Mao | |
| 5,010,662 | A | | 4/1991 | Dabuzhsky et al. | |
| 5,014,449 | A | | 5/1991 | Richard et al. | |
| 5,024,007 | A | | 6/1991 | DuFour | |
| 5,025,573 | A | | 6/1991 | Giese et a. | |
| 5,052,130 | A | | 10/1991 | Barry et al. | |

| | | | | | |
|---|---|---|---|---|---|
| 5,077,916 | A | | 1/1992 | Beneteau | |
| 5,079,856 | A | | 1/1992 | Truelsen | |
| 5,092,060 | A | | 3/1992 | Frachey et al. | |
| 5,131,173 | A | | 7/1992 | Anderie | |
| 5,224,280 | A | | 7/1993 | Preman et al. | |
| 5,224,810 | A | | 7/1993 | Pitkin | |
| 5,237,758 | A | | 8/1993 | Zachman | |
| 5,317,819 | A | * | 6/1994 | Ellis, III | 36/25 R |
| 5,543,194 | A | | 8/1996 | Rudy | |
| 5,544,429 | A | | 8/1996 | Ellis, III | |
| 5,909,948 | A | | 6/1999 | Ellis, III | |
| 6,115,941 | A | | 9/2000 | Ellis, III | |
| 6,115,945 | A | | 9/2000 | Ellis, III | |
| 6,163,982 | A | | 12/2000 | Ellis, III | |

FOREIGN PATENT DOCUMENTS

| | | | |
|---|---|---|---|
| DE | 36 29 245 | | 3/1988 |
| EP | 0 048 965 | | 4/1982 |
| EP | 0 083 449 | A1 | 7/1983 |
| EP | 0 130 816 | | 1/1985 |
| EP | 185781 | | 7/1986 |
| EP | 0 185 781 | | 7/1986 |
| EP | 0 206 511 | | 12/1986 |
| EP | 0 213 257 | | 3/1987 |
| EP | 0 215 974 | | 4/1987 |
| EP | 0 238 995 | | 9/1987 |
| EP | 0 260 777 | | 3/1988 |
| EP | 0 301 331 | A2 | 2/1989 |
| EP | 0 329 391 | | 8/1989 |
| EP | 0 410 087 | A2 | 1/1991 |
| FR | 602.501 | | 3/1926 |
| FR | 602501 | | 3/1926 |
| FR | 925.961 | | 9/1947 |
| FR | 1.004.472 | | 3/1952 |
| FR | 1004472 | | 3/1952 |
| FR | 1.323.455 | | 2/1963 |
| FR | 2 006 270 | | 11/1971 |
| FR | 2 261 721 | | 9/1975 |
| FR | 2 511 850 | | 3/1983 |
| FR | 2 622 411 | | 5/1989 |
| GB | 16143 | | of 1891 |
| GB | 9 591 | | 4/1913 |
| GB | 764956 | | 1/1957 |
| GB | 807305 | | 1/1959 |
| GB | 2 023 405 | | 1/1980 |
| GB | 2 039 717 | | 8/1980 |
| GB | 2136670 | | 9/1984 |
| GB | 2 136 3670 | | 9/1984 |
| JP | 39-15597 | | 8/1964 |
| JP | 45-5154 | | 3/1970 |
| JP | 50-71132 | | 11/1975 |
| JP | 57-139333 | | 8/1982 |
| JP | 4-279102 | | 10/1982 |
| JP | 5923525 | | 7/1984 |
| JP | 59-23525 | | 7/1984 |
| JP | 61-55810 | | 4/1986 |
| JP | 61-167810 | | 10/1986 |
| JP | 1-195803 | | 8/1989 |
| JP | 3-85102 | | 4/1991 |
| JP | 5-123204 | | 5/1993 |
| NZ | 189890 | | 4/1981 |
| WO | WO 87/07480 | | 12/1987 |
| WO | WO 88/08263 | | 11/1988 |
| WO | WO 89/06500 | | 7/1989 |
| WO | WO 91/00358 | | 1/1990 |
| WO | WO 91/00698 | | 1/1991 |
| WO | WO 91/03180 | | 3/1991 |
| WO | WO 91/04683 | | 4/1991 |
| WO | WO 91/05491 | | 5/1991 |
| WO | WO 91/10377 | | 7/1991 |
| WO | WO 91/11124 | | 8/1991 |
| WO | WO 91/11924 | | 8/1991 |
| WO | WO 91/19429 | | 12/1991 |
| WO | WO 92/07483 | | 5/1992 |
| WO | WO 92/18024 | | 10/1992 |
| WO | WO 93/13928 | | 7/1993 |
| WO | WO 94/03080 | | 2/1994 |
| WO | WO 97/00029 | | 1/1997 |
| WO | WO 00/64293 | | 11/2000 |

OTHER PUBLICATIONS

Originally filed Specification for U.S. Pat. application No. 08/477,640 filed Jun. 7, 1995 (ELL–009/Con).

Originally filed Specification for U.S. Pat. application No. 09/648,792 filed Aug. 28, 2000 (ELL–010/Con).

Originally filed Specification for U.S. Pat. application No. 08/376,661 filed Jan. 23, 1995 (ELL–003/Con 3).

Originally filed Specification for U.S. Pat. application No. 09/710,952 filed Nov. 14, 2000 (ELL–003/Div 1).

Originally filed Specification for U.S. Pat. application No. 09/780,450 filed Feb. 12, 2001 (ELL–003/Div 2).

Originally filed Specification for U.S. Pat. application No. 09/790,626 filed Feb. 23, 2001 (ELL–003/Div 3).

Originally filed Specification for U.S. Pat. application No. 09/734,905 filed Dec. 13, 2000 (ELL–012D/Div 1).

Originally filed Specification for U.S. Pat. application No. 09/785,200 filed Feb. 20, 2001 (ELL–012D/Con 2).

Originally filed Specification for U.S. Pat. application No. 08/482,838 filed Jun. 7, 1995 (ELL–011).

Originally filed Specification for U.S. Pat. application No. 08/033,468 filed Mar. 18, 1993 (ELL–006/Con).

Originally filed Specification for U.S. Pat. application No. 08/479,776 filed Jun. 7, 1995 (ELL–014B).

Originally filed Specification for U.S. Pat. application No. 08/462,531 filed Jun. 5, 1995 (ELL–012AA).

Originally filed Specification for U.S. Pat. application No. 08/473,212 filed Jun. 7, 1995 (ELL–012B).

Williams, *Walking on Air, Case Alumnus,* vol. LXVII, No. 6, Fall 1989, pp. 4–8.

Brooks advertisement in *Runner's World* etc., Jun. 1989, p. 56+.

Nigg et al., Influence of Heel Flare and Midsole Construction on Pronation Supination, and Impact Forces for Heel–Toe Running, *International Journal of Sports Biomechanics,* 1988, 4, pp. 205–219.

Nigg et al., The Influence of lateral heel flare of running shoes on pronation and impact forces, *Medicine and Science in Sports and Exercise,* vol. 19, No. 3, 1987, pp. 294–302.

Cavanagh et al., Biological Aspects of Modeling Shoe/Foot Interaction During Running, *Sport Shoes and Playing Surfaces,* 1984, pp. 24–25, 32–35, 46.

Blechschmidt, The Structure of the Calcaneal Padding, *Foot & Anke,* vol. 2, No. 5, Mar. 1982, pp. 260–283.

Cavanagh, *The Running Shoe Book,* © 1980, pp. 176–180, Anderson World, Inc., Mountain View, CA.

Executive Summary with seven figures.

* cited by examiner

CORRECTIVE SHOE SOLE STRUCTURES USING A CONTOUR GREATER THAN THE THEORETICALLY IDEAL STABILITY PLAN

This application is a continuation of U.S. patent application Ser. No. 08/142,120, filed on Oct. 28, 1996, now abandoned, which is a continuation of U.S. patent application Ser. No. 07/830,747, filed on Feb. 7, 1992, now abandoned, which is a continuation of U.S. patent application Ser. No. 07/416,478, filed Oct. 3, 1989, now abandoned.

BACKGROUND OF THE INVENTION

This invention relates generally to the structure of shoes. More specifically, this invention relates to the structure of running shoes. Still more particularly, this invention relates to variations in the structure of such shoes having a sole contour which follows a theoretically ideal stability plane as a basic concept, but which deviates therefrom outwardly, to provide greater than natural stability. Still more particularly, this invention relates to the use of structures approximating, but increasing beyond, a theoretically ideal stability plane to provide greater than natural stability for an individual whose natural foot and ankle biomechanical functioning have been degraded by a lifetime use of flawed existing shoes.

Existing running shoes are unnecessarily unsafe. They seriously disrupt natural human biomechanics. The resulting unnatural foot and ankle motion leads to what are abnormally high levels of running injuries.

Proof of the unnatural effect of shoes has come quite unexpectedly from the discovery that, at the extreme end of its normal range of motion, the unshod bare foot is naturally stable, almost unsprainable, while the foot equipped with any shoe, athletic or otherwise, is artificially unstable and abnormally prone to ankle sprains. Consequently, ordinary ankle sprains must be viewed as largely an unnatural phenomena, even though fairly common. Compelling evidence demonstrates that the stability of bare feet is entirely different from the stability of shoe-equipped feet.

The underlying cause of the universal instability of shoes is a critical but correctable design flaw. That hidden flaw, so deeply ingrained in existing shoe designs, is so extraordinarily fundamental that it has remained unnoticed until now. The flaw is revealed by a novel new biomechanical test, one that is unprecedented in its simplicity. The test simulates a lateral ankle sprain while standing stationary. It is easy enough to be duplicated and verified by anyone; it only takes a few minutes and requires no scientific equipment or expertise.

The simplicity of the test belies its surprisingly convincing results. It demonstrates an obvious difference in stability between a bare foot and a running shoe, a difference so unexpectedly huge that it makes an apparently subjective test clearly objective instead. The test proves beyond doubt that all existing shoes are unsafely unstable.

The broader implication of this uniquely unambiguous discovery are potentially far-reaching. The same fundamental flaw in existing shoes that is glaringly exposed by the new test also appears to be the major cause of chronic overuse injuries, which are unusually common in running, as well as other sport injuries. It causes the chronic injuries in the same way it causes ankle sprains; that is, by seriously disrupting natural foot and ankle biomechanics.

The applicant has introduced into the art the concept of a theoretically ideal stability plane as a structural basis for shoe sole designs. That concept as implemented into shoes such as street shoes and athletic shoes is presented in U.S. Pat. No. 4,989,349, issued Feb. 5, 1991, U.S. Pat. No. 5,317,819, issued Jun. 7, 1994, and Ser. No. 07/400,714, filed an Aug. 30, 1989, well as in PCT Application No. PCT/US89/03076 filed on Jul. 14, 1989. The purpose of the theoretically ideal stability plane as described in these applications was primarily to provide a neutral design that allows for natural foot and ankle biomechanics as close as possible to that between the foot and the ground, and to avoid-the serious interference with natural foot and ankle biomechanics inherent in existing shoes.

This new invention is a modification of the inventions disclosed and claimed in the earlier applications and develops the application of the concept of the theoretically ideal stability plane to other shoe structures. As such, it presents certain structural ideas which deviate outwardly from the theoretically ideal stability plane to compensate for faulty foot biomechanics caused by the major flaw in existing shoe designs identified in the earlier patent applications.

The shoe sole designs in this application are based on a recognition that lifetime use of existing shoes, the unnatural design of which is innately and seriously flawed, has produced actual structural changes in the human foot and ankle. Existing shoes thereby have altered natural human biomechanics in many, if not most, individuals to an extent that must be compensated for in an enhanced and therapeutic design. The continual repetition of serious interference by existing shoes appears to have produced individual biomechanical changes that may be permanent,so simply removing the cause is not enough. Treating the residual effect must also be undertaken.

Accordingly, it is a general object of this invention to elaborate upon the application of the principle of the theoretically ideal stability plane to other shoe structures.

It is still another object of this invention to provide a shoe having a sole contour which deviates outwardly in a constructive way from the theoretically ideal stability plane.

It is another object of this invention to provide a sole contour having a shape naturally contoured to the shape of a human foot, but having a shoe sole thickness which is increases somewhat beyond the thickness specified by the theoretically ideal stability plane.

It is another object of this invention to provide a naturally contoured shoe sole having a thickness somewhat greater than mandated by the concept of a theoretically ideal stability plane, either through most of the contour of the sole, or at preselected portions of the sole.

It is yet another object of this invention to provide a naturally contoured shoe sole having a thickness which approximates a theoretically ideal stability plane, but which varies toward either a greater thickness throughout the sole or at spaced portions thereof, or toward a similar but lesser thickness.

These and other objects of the invention will become apparent from a detailed description of the invention which follows taken with the accompanying drawings.

BRIEF SUMMARY OF THE INVENTION

Directed to achieving the aforementioned objects and to overcoming problems with prior art shoes, a shoe according to the invention comprises a sole having at least a portion thereof following approximately the contour of a theoretically ideal stability plane, preferably applied to a naturally contoured shoe sole approximating the contour of a human foot.

In another aspect, the shoe includes a naturally contoured sole structure exhibiting natural deformation which closely parallels the natural deformation of a foot under the same load, and having a contour which approximates, but increases beyond the theoretically ideal stability plane. When the shoe sole thickness is increased beyond the theoretically ideal stability plane, greater than natural stability results; when thickness is decreased, greater than natural motion results.

In a preferred embodiment, such variations are consistent through all frontal plane cross sections so that there are proportionally equal increases to the theoretically ideal stability plane from front to back as the shoe sole thickness increases from the forefoot area to the heel area, as do most existing shoes, when measured in sagittal plane cross sections. In alternative embodiments, the thickness may increase, then decrease at respective adjacent locations, or vary in other thickness sequences.

The thickness variations may be symmetrical on both sides, or asymmetrical, particularly since it may be desirable to provide greater stability for the medial side than the lateral side to compensate for common pronation problems. The variation pattern of the right shoe can vary from that of the left shoe. Variation in shoe sole density or bottom sole tread can also provide reduced but similar effects.

These and other features of the invention will become apparent from the detailed description of the invention which follows.

DETAILED DESCRIPTION OF THE PREFERRED EMBODIMENTS

Figure 1:
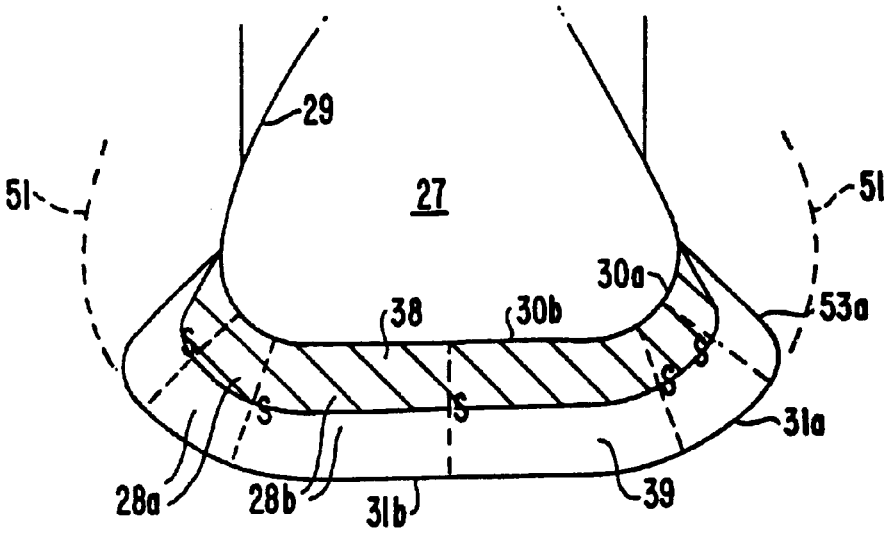
FIG. 1 shows, in frontal plane cross section at the heel portion of a shoe, the applicant's prior invention of a shoe sole with naturally contoured sides based on a theoretically ideal stability plane.
Figure 2:
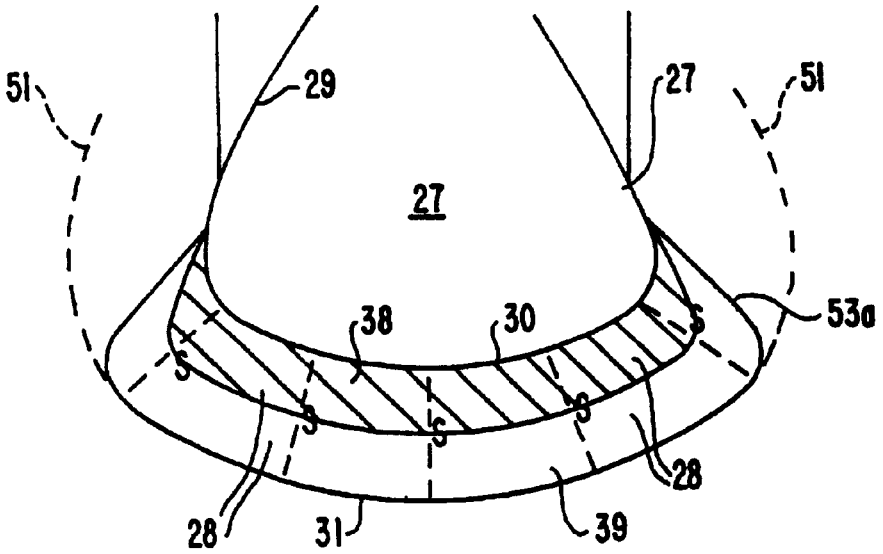
FIG. 2 shows, again in frontal plane cross section, the most general case of the applicant's prior invention, a fully contoured shoe sole that follows the natural contour of the bottom of the foot as well as its sides, also based on the theoretically ideal stability plane.
Figure 3A:
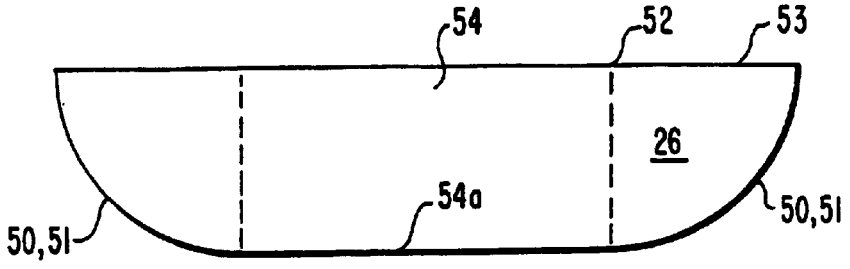
FIG. 3, as seen in FIGS. 3A to 3C in frontal plane cross section at the heel, shows the applicant's prior invention for conventional shoes, a quadrant-sided shoe sole, based on a theoretically ideal stability plane.
Figure 3B:
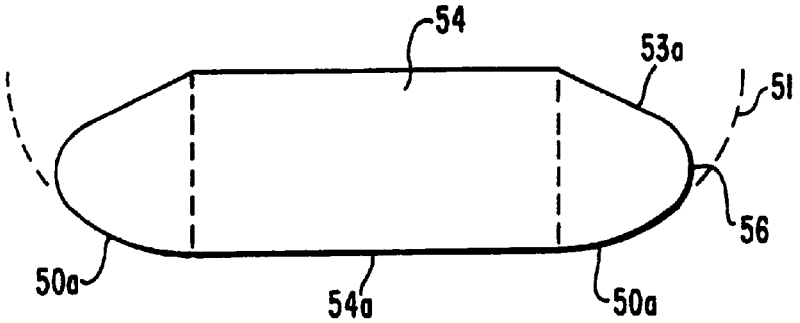
Figure 3C:
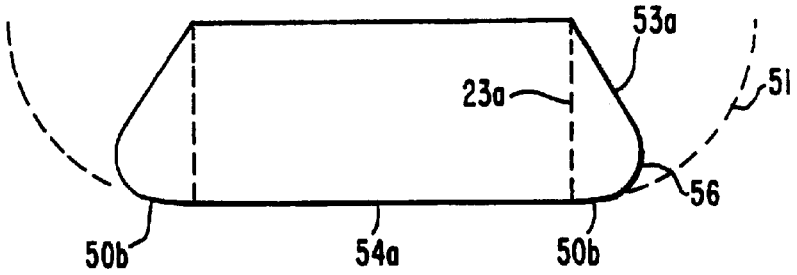
Figure 4:
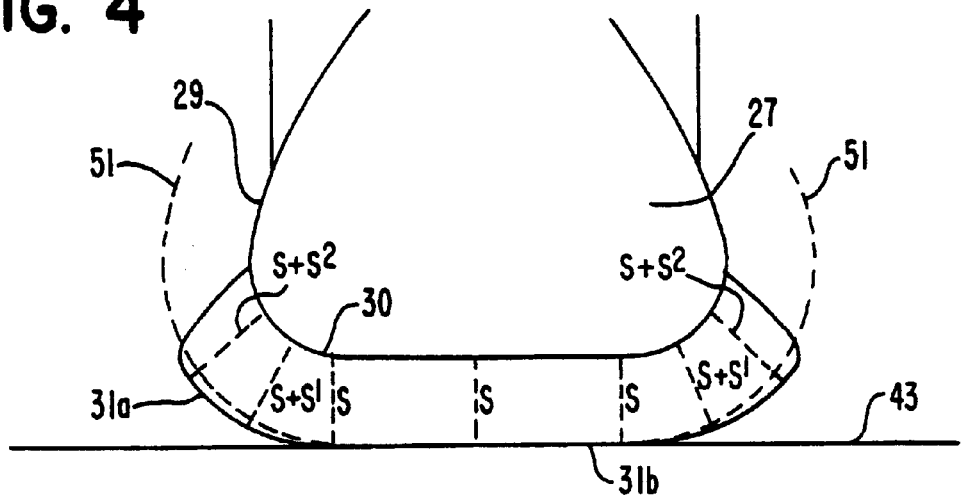
FIG. 4 shows a frontal plane cross section at the heel portion of a shoe with naturally contoured sides like those of FIG. 1, wherein a portion of the shoe sole thickness is increased beyond the theoretically ideal stability plane.

FIGS. 1, 2, and 3 show frontal plane cross sectional views of a shoe sole according to the applicant's prior inventions based on the theoretically ideal stability plane, taken at about the ankle joint to show the heel section of the shoe. FIGS. 4 through 13 show the same view of the applicant's enhancement of that invention. The reference numerals are like those used in the prior pending applications of the applicant mentioned above and which are incorporated by reference for the sake of completeness of disclosure, if necessary. In the figures, a foot 27 is positioned in a naturally contoured shoe having an upper 21 and a sole 28. The shoe sole normally contacts the ground 42 at about the lower central heel portion thereof, as shown in FIG. 4. The concept of the theoretically ideal stability plane, as developed in the prior applications as noted, defines the plane 51 in terms of a locus of points determined by the thickness (s) of the sole. The thickness (s) of the sole at a particular location is measured by the length of a line extending from the sole inner surface to the sole outer surface, the line being perpendicular to a line tangent to the sole inner surface at the measured location, all as viewed in a frontal plane cross section of the sole. See, for example, FIGS. 1, 2, and 4–7. This thickness (s) may also be referred to as a "radial thickness" of the shoe sole.

FIG. 1 shows, in a rear cross sectional view, the application of the prior invention showing the inner surface of the shoe sole conforming to the natural contour of the foot and the thickness of the shoe sole remaining constant in the frontal plane, go that the outer surface coincides with the theoretically ideal stability plane.

FIG. 2 shows a fully contoured shoe sole design of the applicant's prior invention that follows the natural contour of all of the foot, the bottom as well as the sides, while retaining a constant shoe sole thickness in the frontal plane.

The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 2 would deform by flattening to look essentially like FIG. 1. Seen in this light, the naturally contoured side design in FIG. 1 is a more conventional, conservative design that is a special case of the more general fully contoured design in FIG. 2, which is the closest to the natural form of the foot, but the least conventional. The amount of deformation flattening used in the FIG. 1 design, which obviously varies under different loads, is not an essential element of the applicant's invention.

FIGS. 1 and 2 both show in frontal plane cross sections the essential concept underlying this invention, the theoretically ideal stability plane, which is also theoretically ideal for efficient natural motion of all kinds, including running, jogging or walking. FIG. 2 shows the most general case of the invention, the fully contoured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29.

For the special case shown. in FIG. 1, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individuals load-bearing footprint 30*b,* which is defined as the upper surface of the shoe sole that is in physical contact with and supports the human foot sole.

The theoretically ideal stability plane for the special case is composed conceptually of two parts. Shown in FIG. 1, the first part is a line segment 31*b* of equal length and parallel to line 30*b* at a constant distance (s) equal to shoe sole thickness. This corresponds to a conventional shoe sole directly underneath the human foot, and also corresponds to the flattened portion of the bottom of the load-bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*. Accordingly, thickness (s) is equal to the length of a line extending from a desired point on the contoured side inner edge 30*a* to a point on the contoured side outer edge 31*a*, wherein the line extends normal to a line tangent to the contoured side inner edge 30*a* at the desired point.

In summary, the theoretically ideal stability plane is the essence of this invention because it is used to determine a geometrically precise bottom contour of the shoe sole based on a top contour that conforms to the contour of the foot. This invention Difically claim the exactly determined geometric relationship just described.

It can be stated unequivocally that any shoe sole contour, even of similar contour, that exceeds the theoretically ideal stability plane will restrict natural foot motion, while any less than that plane will degrade natural stability, in direct proportion to the amount of the deviation. The theoretical ideal was taken to be that which is closest to natural.

FIG. 3 illustrates in frontal plane cross section another variation of the applicant's prior invention that uses stabilizing quadrants 26 at the outer edge of a conventional shoe sole 28*b* illustrated generally at the reference numeral 28. The stabilizing 2 adrants would be abbreviated in actual embodiments.

FIG. 4 illustrates the applicant's new invention of shoe sole side thickness increasing beyond the theoretically ideal stability plane to increase stability somewhat beyond its natural level. The unavoidable trade-off resulting is that natural motion would be restricted somewhat and the weight of the shoe sole would increase somewhat.

FIG. 4 shows a situation wherein the thickness of the sole at each of the opposed sides is thicker at the portions of the sole 31*a* by a thickness which gradually varies continuously from a thickness (s) through a thickness (s+s1), to a thickness (s+s2). Again, as shown in the figures and noted above, the thickness (s) of the sole at a particular location is measured by the length of a line extending from the sole inner surface to the sole outer surface, the line being perpendicular to a line tangent to the sole inner surface at the measured location, all as viewed in a frontal plane cross section of the sole. This thickness (s) may also be referred to as a "radial thickness" of the shoe sole.

These designs recognize that lifetime use of existing shoes, the design of which has an inherent flaw that continually disrupts natural human biomechanics, has produced thereby actual structural changes in a human foot and ankle to an extent that, must be compensated for. Specifically, one of the most common of the abnormal effects of the inherent existing flaw is a weakening of the long arch of the foot, increasing pronation. These designs therefore modify the applicant's preceding designs to provide greater than natural stability and should be particularly useful to individuals, generally with low arches, prone to pronate excessively, and could be used only on the medial side. Similarly, individuals with high arches and a tendency to over supinate and lateral ankle sprains would also benefit, and the design could be used only on the lateral side. A shoe for the general population that compensates for both weaknesses in the same shoe would incorporate the enhanced stability of the design compensation on both sides.

The new design in FIG. 4, like FIGS. 1 and 2, allows the shoe sole to deform naturally closely paralleling the natural deformation of the barefoot underload; in addition, shoe sole material must be of such composition as to allow the natural deformation following that of the foot.

The new designs retain the essential novel aspect of the earlier designs; namely, contouring the shape of the shoe sole to the shape of the human foot. The difference is that the shoe sole thickness in the frontal plane is allowed to vary rather than remain uniformly constant. More specifically, FIGS. 4, 5, 6, 7, and 11 show, in frontal plane cross sections at the heel, that the shoe sole thickness can increase beyond the theoretically ideal stability plane 51, in order to provide greater than natural stability. Such variations (and the following variations) can be consistent through all frontal plane cross sections, so that there are proportionately equal increases to the theoretically ideal stability plane 51 from the front of the shoe sole to the back, or that the thickness can vary, preferably continuously, from one frontal plane to the next.

The exact amount of the increase in shoe sole thickness beyond the theoretically ideal stability plane is to be determined empirically. Ideally, right and left shoe soles would be custom designed for each individual based on an biomechanical analysis of the extent of his or her foot and ankle disfunction in order to provide an optimal individual correction. If epidemiological studies indicate general corrective patterns for specific categories of individuals or the population as a whole, then mass-produced corrective shoes with soles incorporating contoured sides exceeding the theoretically ideal stability plane would be possible. It is expected that any such mass-produced corrective shoes for the general population would have thicknesses exceeding the theoretically ideal stability plane by an amount up to 5 or 10 percent, while more specific groups or individuals with more severe disfunction could have an empirically demonstrated need for greater corrective thicknesses on the order of up to 25 percent more than the theoretically ideal stability plane. The optimal contour for the increased thickness may also be determined empirically.

Figure 5:
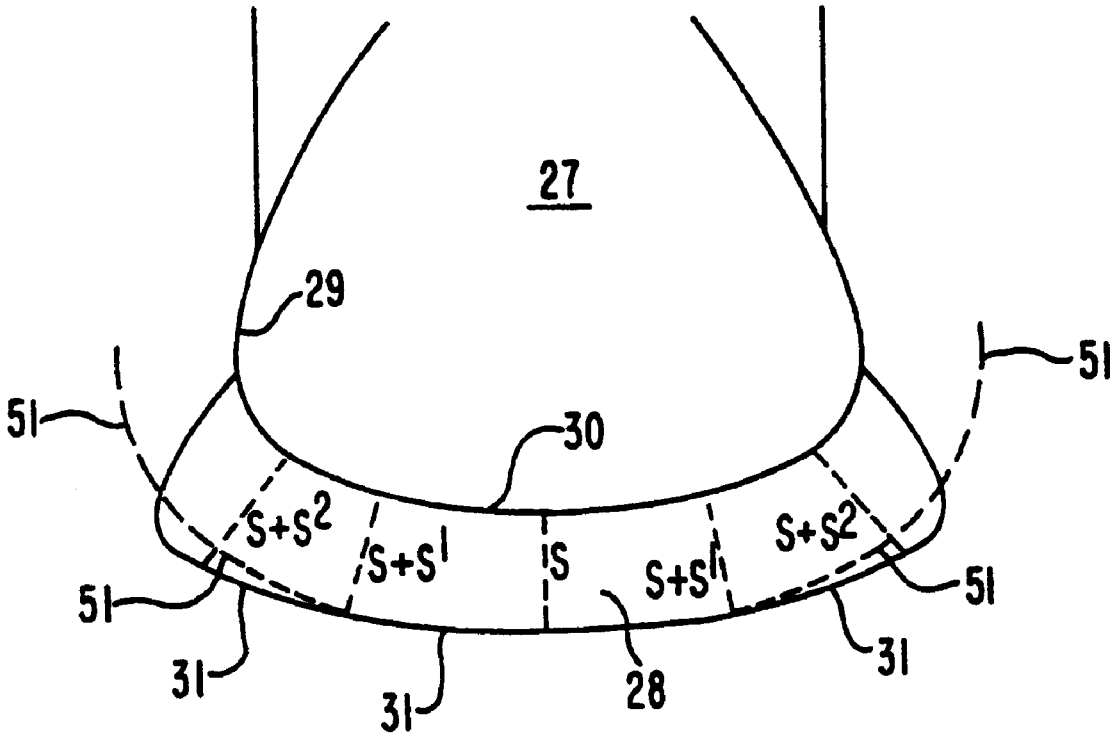
FIG. 5 is a view similar to FIG. 4, but of a shoe with fully contoured sides wherein the sole thickness increases with increasing distance from the center line of the ground-engaging portion of the sole.

FIG. 5 shows a variation of the enhanced fully contoured design wherein the shoe sole begins to thicken beyond the theoretically ideal stability plane 51 somewhat offset to the sides.

Figure 6:
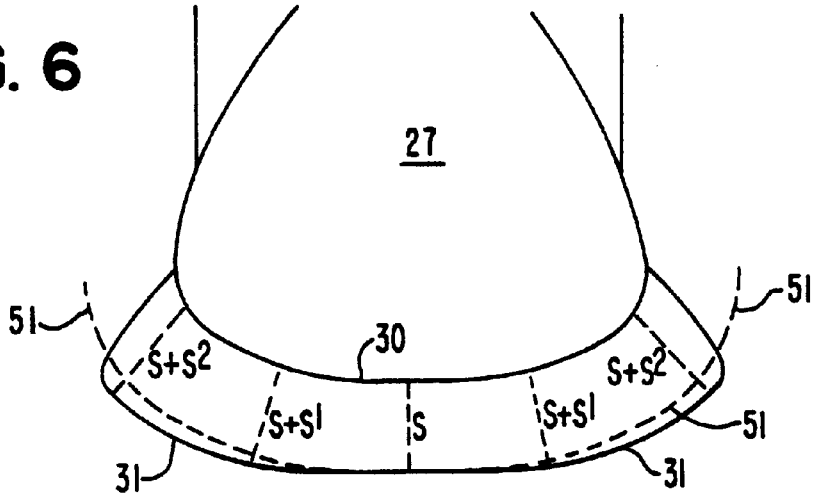
FIG. 6 is a view similar to FIG. 5, where the fully contoured sole thickness variations are continually increasing on each side.

FIG. 6 shows a thickness variation which is symmetrical as in the case of FIGS. 4 and 5, but wherein the shoe sole begins to thicken beyond the theoretically ideal stability plane 51 directly underneath the foot heel 27 on about a center line of the shoe sole. In fact, in this case the thickness of the shoe sole is the same as the theoretically ideal stability plane only at that beginning point underneath the upright foot. For the applicant's new invention where the shoe sole thickness varies, the theoretically ideal stability plane is determined by the least thickness in the shoe sole's direct load-bearing portion meaning that portion with direct tread contact on the ground; the outer edge or periphery of the shoe sole is obviously excluded, since the thickness there always decreases to zero. Note that the capability to deform naturally of the applicant's design may make some portions of the shoe sole load-bearing when they are actually under a load, especially walking or running, even though they might not appear to be when not under a load.

Figure 7:
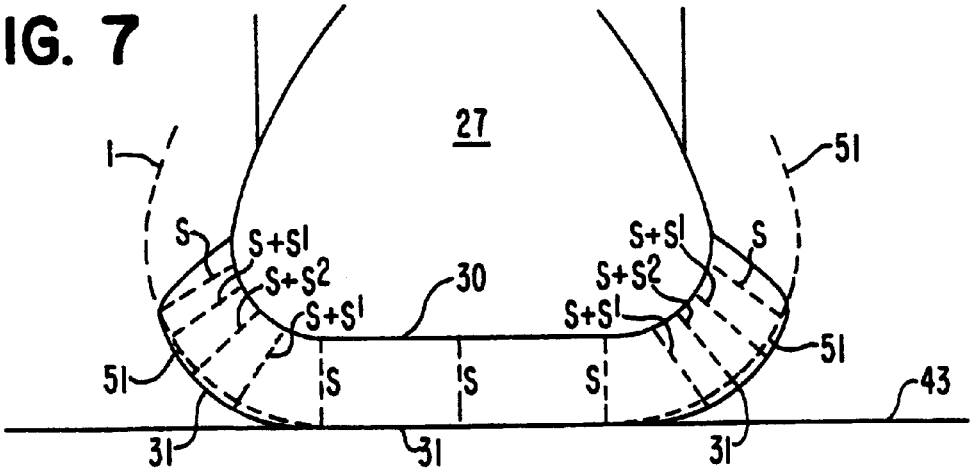
FIG. 7 is a view similar to FIGS. 4 to 6 wherein the sole thicknesses vary in diverse sequences.

FIG. 7 shows that the thickness can also increase and then decrease; other thickness variation sequences are also possible. The variation in side contour thickness in the new invention can be either symmetrical on both sides or asymmetrical, particularly with the medial side providing more stability than the lateral side, although many other asymmetrical variations are possible, and the pattern of the right foot can vary from that of the left foot.

FIGS. 8, 9, 10 and 12 show that similar variations in shoe midsole (other portions of the shoe sole area not shown) density can provide similar but reduced effects to the variations in shoe sole thickness described previously in FIGS. 4 through 7, since the thickness of lower density material is obviously reduced somewhat more under load-bearing compression than is that of higher sensity material. The major advantage of this approach is that the structural theoretically ideal stability plane is retained, so that naturally optimal stability and efficient motion are retained to the maximum extent possible.

Figure 8:
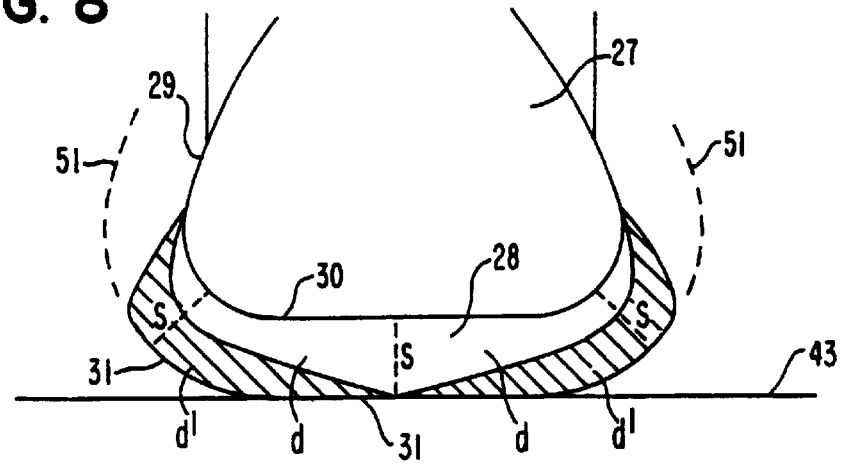
FIG. 8 is a frontal plane cross section showing a density variation in the midsole.
Figure 9:
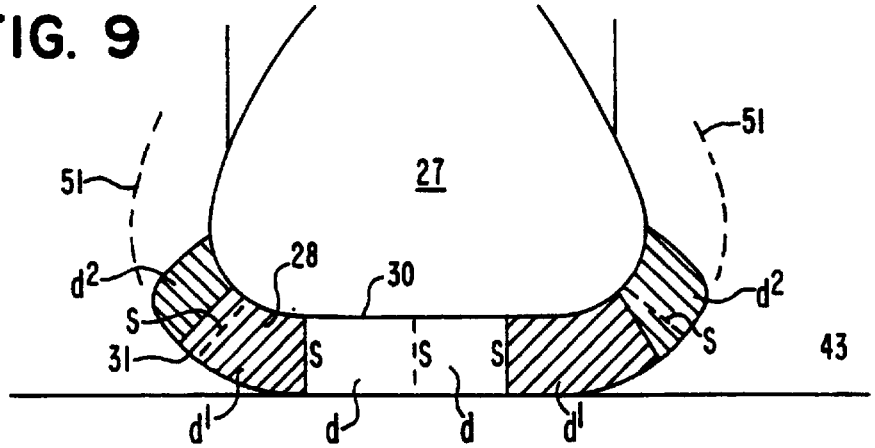
FIG. 9 is a view similar to FIG. 8 wherein the firmest density material is at the outermost edge of the midsole contour.

The forms of dual and tri-density midsoles shown in the figures are extremely common in the current art of running shoes, and any number of densities are theoretically possible, although an angled alternation of just two densities like that shown in FIG. 8 provides continually changing composite density. However, the applicant's prior invention did not prefer multi-densities in the midsole, since only a uniform density provides a neutral shoe sole design that does not interfere with natural foot and ankle biomechanics in the way that multi-density shoe soles do, which is by providing different amounts of support to different parts of the foot; it did not, of course, preclude such multi-density midsoles. In these figures, the density of the sole material designated by the legend (d1) is firmer than (d) while (d2) is the firmest of the three representative densities shown. In FIG. 8, a dual density sole is shown, with (d) having the less firm density.

It should be noted that shoe soles using a combination both of sole thicknesses greater than the theoretically ideal stability plane and of midsole densities variations like those just described are also possible but not shown.

Figure 10:
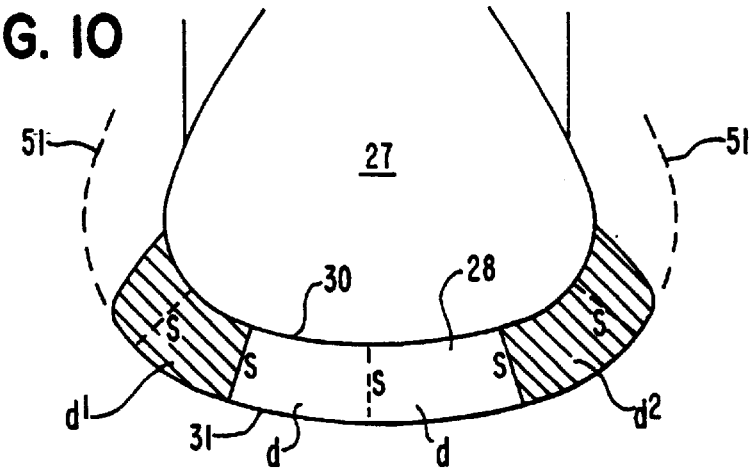
FIG. 10 is a view similar to FIGS. 8 and 9 showing still another density variation, one which is asymetrical.
Figure 11:
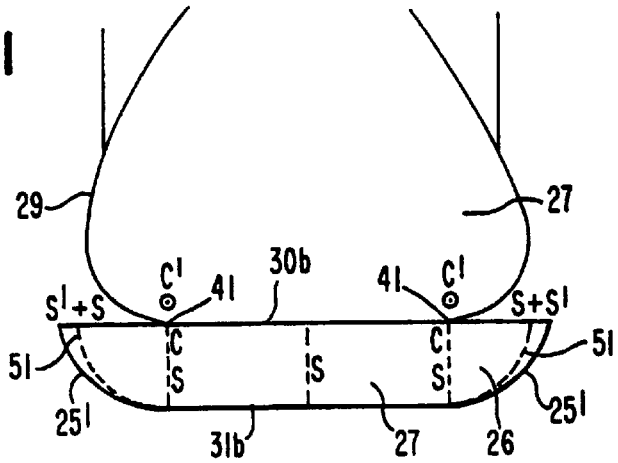
FIG. 11 shows a variation in the thickness of the sole for the quadrant embodiment which is greater than a theoretically ideal stability plane.
Figure 12:
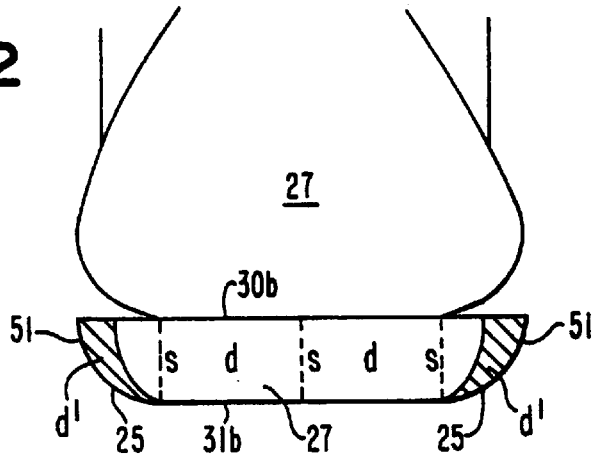
FIG. 12 shows a quadrant embodiment as in FIG. 11 wherein the density of the sole varies.
Figure 13:
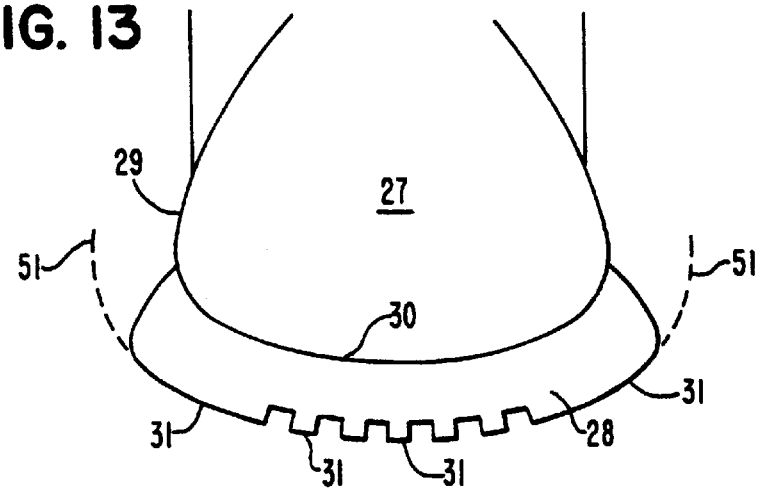
FIG. 13 shows a bottom sole tread design that provides a similar density variation as that in FIG. 10.

FIG. 13 shows a bottom sole tread design that provides about the same overall shoe sole density variation as that provided in FIG. 10 by midsole density variation. The less supporting tread there is under any particular portion of the shoe sole, the less effective overall shoe sole density there is, since the midsole above that portion will deform more easily that if it were fully supported.

FIG. 14 shows embodiments like those in FIGS. 4 through 13 but wherein a portion of the shoe sole thickness is decreased to less than the theoretically ideal stability plane. It is anticipated that some individuals with foot and ankle biomechanics that have been degraded by existing shoes may benefit from such embodiments, which would provide less than natural stability but greater freedom of motion, and less shoe sole weight add bulk. In particular, it is anticipated that individuals with overly rigid feet, those with restricted range of motion, and those tending to over-supinate may benefit from the FIG. 14 embodiments. Even more particularly, it is expected that the invention will benefit individuals with significant bilateral foot function asymmetry: namely, a tendency toward pronation on one foot and supination on the other foot. Consequently, it is anticipated that this embodiment would be used only on the shoe sole of the supinating foot, and on the inside portion only, possibly only a portion thereof. It is expected that the range less than the theoretically ideal stability plane would be a maximum of about five to ten percent, though a maximum of up to twenty-five percent may be beneficial to some individuals.

Figure 14A:
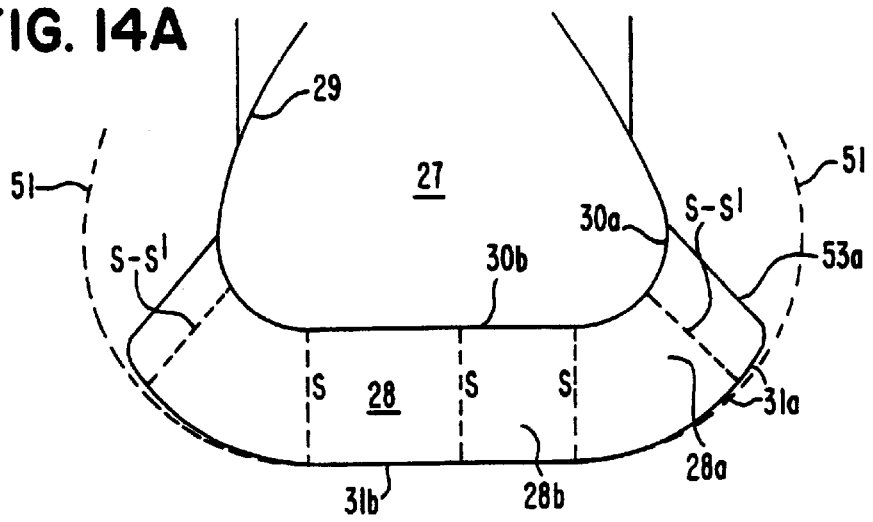
FIG. 14 shows embodiments like FIGS. 1 through 3 but wherein a portion of the shoe sole thickness is decreased to less than the theoretically ideal stability plane.
Figure 14B:
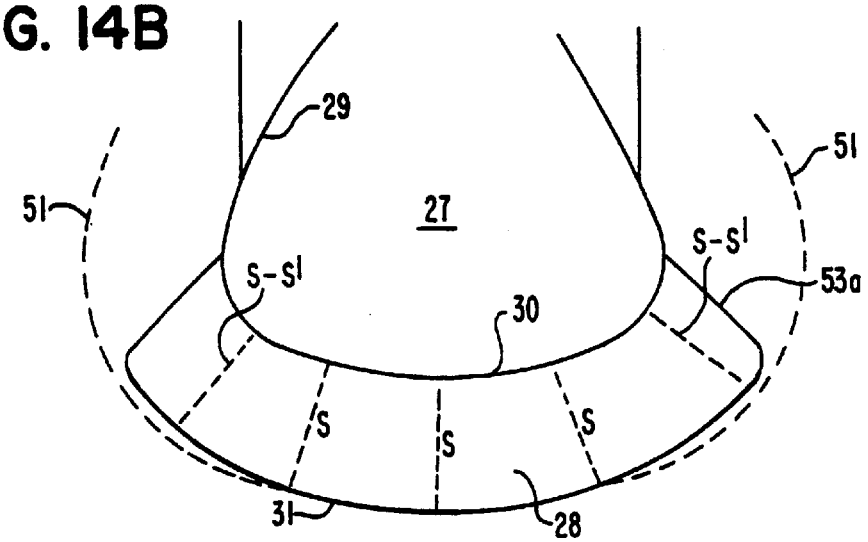
Figure 14C:
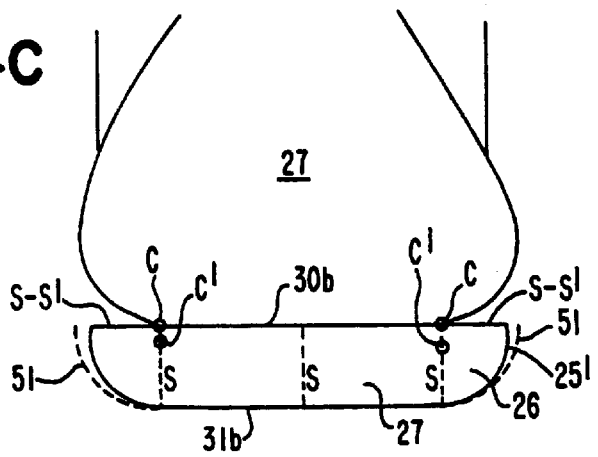

FIG. 14A shows an embodiment like FIGS. 4 and 7, but with naturally contoured sides less than the theoretically ideal stability plane. FIG. 14B shows an embodiment like the fully contoured design in FIGS. 5 and 6, but with a shoe sole thickness decreasing with increasing distance from the center portion of the sole. FIG. 14C shows an embodiment like the quadrant-sided design of FIG. 11, but with the quadrant sides increasingly reduced from the theoretically ideal stability plane.

The lesser-sided design of FIG. 14 would also apply to the FIGS. 8 through 10 and 12 density variation approach and to the FIG. 13 approach using tread design to approximate density variation.

Figure 15A:
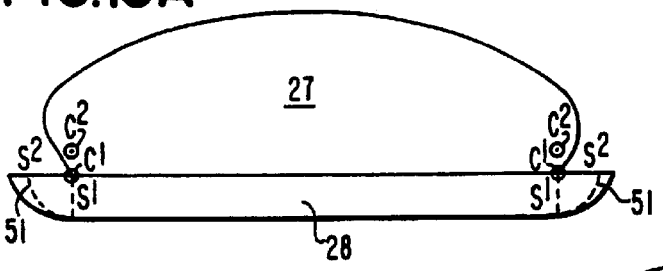
FIG. 15 show embodiments with sides both greater and lesser than the theoretically ideal stability plane.
Figure 15D:
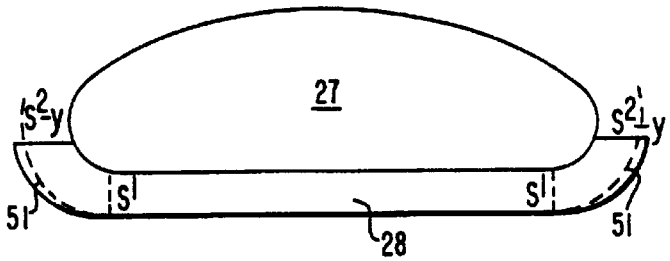
Figure 15B:
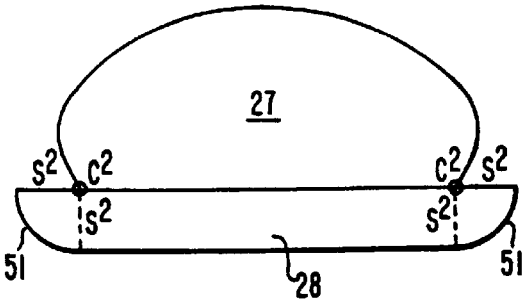
Figure 15E:
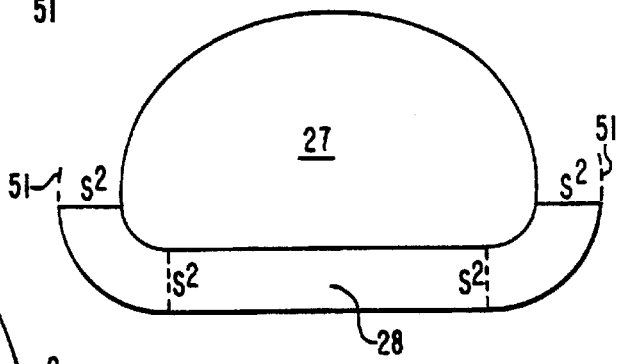
Figure 15C:
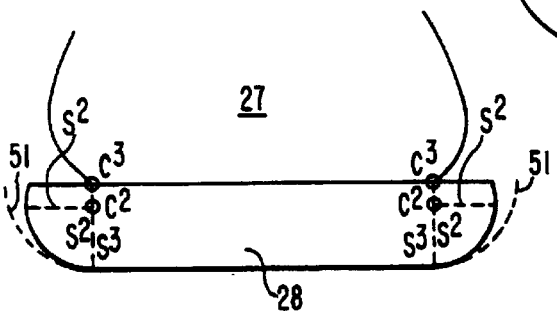

FIG. 15A–C show, in cross sections similar to those in pending U.S. application Ser. No. 07/219,387, that with the quadrant-sided design of FIGS. 3, 11, 12 and 14C that it is possible to have shoe sole sides that are both greater and lesser than the theoretically ideal stability plane in the same shoe. The radius of an intermediate shoe sole thickness, taken at ($S^2$) at the base of the fifth metatarsal in FIG. 15B, is maintained constant throughout the quadrant sides of the shoe sole, including both the heel, FIG. 15C, and the forefoot, FIG. 15A, so that the side thickness is less than the theoretically ideal stability plane at the heel and more at the forefoot. Though possible, this is not a preferred approach.

Figure 15F:
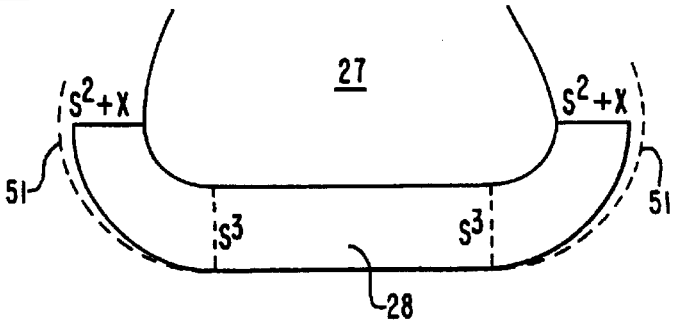

The same approach can be applied to the naturally contoured sides or fully contoured designs described in FIGS. 1, 2, 4 through 10 and 13, but it is also not preferred. In addition, is shown in FIGS. 15 D–F, in cross sections similar to those in pending U.S. application Ser. No. 07/239,667, it is possible to have shoe sole sides that are both greater and lesser than the theoretically ideal stability plane in the same shoe, like FIGS. 15A–C, but wherein the side thickness (or radius) is neither constant like FIGS. 15A–C or varying directly with shoe sole thickness, like in the applicant's pending applications, but instead varying quite indirectly with shoe sole thickness. As shown in FIGS. 15D–F, the shoe sole side thickness varies from somewhat less than shoe sole thickness at the heel to somewhat more at the forefoot. This approach, though possible, is again not preferred, and can be applied to the quadrant sided design, but is not preferred there either.

The foregoing shoe designs meet the objectives of this invention as stated above. However, it will clearly be understood by those skilled in the art that the foregoing description has been made in terms of the preferred embodiments and various changes and modifications may be made without departing from the scope of the present invention which is to be defined by the appended claims.

What is claimed is:

1. A sole suitable for an athletic shoe comprising:

a sole outer surface;

a sole inner surface;

a sole forefoot area at a location substantially corresponding to the location of a forefoot of an intended wearer's foot when inside the shoe;

a sole heel area at a location substantially corresponding to the location of a heel of an intended wearer's foot when inside the shoe;

a sole midtarsal area at a location substantially corresponding to the area between the heel and the forefoot of the intended wearer's foot when inside the shoe;

a midsole having three different densities;

the sole surfaces of the sole for an athletic shoe defining a sole medial side, a sole lateral side, and a sole middle portion between the sole medial and lateral sides, the sole outer surface of one of the lateral and medial sides comprising a concavely rounded portion extending at least below a level of a lowest point of the sole inner surface, as viewed in a shoe sole frontal plane cross-section of the sole heel area when the shoe sole is upright and in an unloaded condition, the concavity of the concavely rounded portion existing with respect to an inner section of the shoe sole directly adjacent to the concavely rounded outer surface portion, the sole inner surface of the side of the shoe sole which has a concavely rounded outer surface portion comprising a convexly rounded portion, as viewed in the shoe sole frontal plane cross-section when the shoe sole is upright and in an unloaded condition, the convexity of the convexly rounded portion existing with respect to a section of the shoe sole directly adjacent to the convexly rounded inner surface portion; and a sole side portion located between the convexly rounded portion of the sole inner surface and the concavely rounded portion of the sole outer surface having a thickness measured from the sole inner surface to the sole outer surface that is greater than a least thickness of the sole middle portion measured from the sole inner surface to the sole outer surface, as viewed in the frontal plane cross-section when the shoe sole is upright and in an unloaded condition.

2. The sole as set forth in claim 1, wherein the midsole comprises portions with first, second and third densities, the portion having the first density being located adjacent a side edge of the shoe sole and the portion having the second density being located adjacent to a center line of the shoe sole, all as viewed in the frontal plane cross-section when the shoe sole is upright and in an unloaded condition, said frontal plane cross-section being located in the heel area of the shoe sole, and the first density is greater than the second density when the shoe sole is in an unloaded condition.

3. The sole as set forth in claim 1, wherein:

the midsole comprises portions of first, second and third densities, said portion of first density having a lesser density than said portion of second density, said area of first density being located in a heel area of the shoe sole, and said portion of second density being located adjacent said portion of first density.

4. The sole as set forth in claim 3, wherein both the sole lateral side and the sole medial side comprise a convexly rounded inner surface portion and a concavely rounded outer surface portion, as viewed in the shoe sole frontal plane cross-section when the shoe sole is upright and in an unloaded condition, the convexity of the convexly rounded inner surface portion existing with respect to a section of the shoe sole directly adjacent to the convexly rounded inner surface portion, and the concavity of the concavely rounded outer surface portion existing with respect to an inner section of the shoe sole directly adjacent to the concavely rounded outer surface portion.

5. The shoe sole as set forth in claim 3, wherein said concavely rounded portion of the sole outer surface extends down to near a lowest point of one of the lateral and medial sides of the shoe sole, as viewed in the shoe sole frontal plane cross-section when the shoe sole is upright and in an unloaded condition, and the thickness of the side portion of the shoe sole being defined as a length of a line starting at a starting point on the sole inner surface and extending to the sole outer surface in a direction perpendicular to a line tangent to the sole inner surface at the starting point, all as viewed in a shoe sole frontal plane cross-section when the shoe sole is upright and in an unloaded condition.

6. The sole as set forth in claim 3, wherein one of said portions of first and second density in the midsole has a greater thickness in the side portion than a thickness of the same midsole portion in the sole middle portion, as viewed in the shoe sole frontal plane cross-section when the shoe sole is upright and in an unloaded condition.

7. The shoe sole set forth in claim 3, wherein the concavely rounded portion of the sole outer surface extends through a sidemost extent of the sole outer surface of the sole side having the concavely rounded outer surface portion, as viewed in the shoe sole frontal plane cross-section when the shoe sole is upright and in an unloaded condition.

8. The shoe sole as set forth in claim 1, wherein the at least one shoe sole side having a concavely rounded outer surface portion extends up to a level above the lowest point of the inner surface of the shoe sole, as viewed in a shoe sole frontal plane cross-section of the sole heel portion when the shoe sole is upright and in an unloaded condition.

9. The shoe sole as set forth in claim 8, wherein the thickness of the at least one shoe sole side having a concavely rounded outer surface portion increases from a first thickness at an uppermost point on the shoe sole side to a greater thickness at a portion of said shoe sole side below said uppermost point, as viewed in a shoe sole frontal plane cross-section of the sole heel portion when the shoe sole is upright and in an unloaded condition; and the thickness of the shoe sole being defined as the length of a line starting at a starting point on the sole inner surface and extending to a point on the sole outer surface in a direction perpendicular to a line tangent to the sole inner surface at the starting point, as viewed in a shoe sole frontal plane cross-section of the sole heel portion when the shoe sole is upright and in an unloaded condition.

10. The shoe sole as set forth in claim 1, wherein the concavely rounded sole outer surface portion extends from an uppermost portion of the shoe sole side to a level below the lowest point of the sole inner surface, as viewed in a shoe sole frontal plane cross-section of the sole heel portion when the shoe sole is upright and in an unloaded condition.

11. The shoe sole as set forth in claim 1, wherein the portions of the midsole having three different densities can be viewed in a single frontal plane cross-section when the shoe sole is upright and in an unloaded condition.

12. The shoe sole as set forth in claim 1, wherein the concavely rounded sole outer surface portion extends through a lowermost point of the shoe sole side, as viewed in a shoe sole frontal plane cross-section of the sole heel portion when the shoe sole is upright and in an unloaded condition.

13. The shoe sole as set forth in claim 1, wherein each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition.

14. The shoe sole as set forth in claim 13, wherein the thickness of the portion of the midsole which extends into the sidemost section of the at least one shoe sole side having a concavely rounded outer surface portion increases from a first thickness at an uppermost point on the midsole to a greater thickness at a portion of said midsole below said uppermost point, as viewed in a shoe sole frontal plane cross-section of the sole heel portion when the shoe sole is upright and in an unloaded condition; and the thickness of the midsole portion being defined as the length of a line starting at a starting point on the inner surface of the midsole portion and extending to an outer surface of the midsole portion in a direction perpendicular to a line tangent to the inner surface of the midsole portion at the starting point, as viewed in a shoe sole frontal plane cross-section of the sole heel portion when the shoe sole is upright and in an unloaded condition.

15. The shoe sole as set forth in claim 1, wherein a midsole portion of greatest density is located adjacent a side edge of the shoe sole, a midsole portion of least density is located adjacent a centerline of the shoe sole, and a midsole portion of intermediate density is located between the midsole portion of greatest density and the midsole portion of least density, as viewed in a frontal plane cross-section when the shoe sole is upright and in an unloaded condition.

16. The shoe sole as set forth in claim 11, further comprising a second midsole portion of greatest density adjacent a second side edge of the shoe sole and a second midsole portion of intermediate density located between the second midsole portion of greatest density and the midsole portion of least density, as viewed in a frontal plane cross-section when the shoe sole is upright and in an unloaded condition.

17. The shoe sole as set forth in claim 1, wherein a midsole portion of least density is located adjacent a centerline of the shoe sole, a midsole portion of greatest density is located on a first side of the midsole portion of least density, and a midsole portion of intermediate density is located on a second side of the midsole portion of least density, as viewed in a frontal plane cross-section when the shoe sole is upright and in an unloaded condition.

18. A shoe sole as claimed in claim 17, wherein the midsole portions of intermediate and greatest density are also located adjacent to first and second side edges of the shoe sole, as viewed in a frontal plane cross-section when the shoe sole is upright and in an unloaded condition.

19. A sole for an athletic shoe comprising:

a sole outer surface;

a sole inner surface;

a sole forefoot area at a location substantially corresponding to the location of a forefoot of an intended wearer's foot when inside the shoe;

a sole heel area at a location substantially corresponding to the location of a heel of an intended wearer's foot when inside the shoe;

a sole midtarsal area at a location substantially corresponding to the area between the heel and the forefoot of the intended wearer's foot when inside the shoe;

a midsole having three different firmnesses;

the sole surfaces of the sole for an athletic shoe defining a sole medial side, a sole lateral side, and a sole middle portion between the sole medial and lateral sides, the sole outer surface of one of the lateral and medial sides comprising a concavely rounded portion extending at least below a level of a lowest point of the sole inner surface, as viewed in a shoe sole frontal plane cross-section of the sole heel area when the shoe sole upright and in an unloaded condition, the concavity of the concavely rounded portion existing with respect to an inner section of the shoe sole directly adjacent to the concavely rounded outer surface portion, the sole inner surface of the side of the shoe sole which has a concavely rounded outer surface portion comprising a convexly rounded portion, as viewed in the shoe sole frontal plane cross-section of the sole heel area when the shoe sole is upright and in an unloaded condition, the convexity of the convexly rounded portion existing with respect to a section of the shoe sole directly adjacent to the convexly rounded inner surface portion; and a sole side portion located between the convexly rounded portion of the sole inner surface and the concavely rounded portion of the sole outer surface having a thickness measured from the sole inner surface of the sole outer surface that is greater than a least thickness of the sole middle portion measured from the sole inner surface to the sole outer surface, as viewed in the frontal plane cross-section when the shoe sole is upright and in an unloaded condition.

20. The shoe sole as set forth in claim 19, wherein the at least one shoe sole side having a concavely rounded outer surface portion extends up to a level above the lowest point of the inner surface of the shoe sole, as viewed in a shoe sole frontal plane cross-section of the sole heel portion when the shoe sole is upright and in an unloaded condition.

21. The shoe sole as set forth in claim 20, wherein the thickness of the at least one shoe sole side having a concavely rounded outer surface portion increases from a first thickness at an uppermost point on the shoe sole side to a greater thickness at a portion of said shoe sole side below said uppermost point, as viewed in a shoe sole frontal plane cross-section of the sole heel portion when the shoe sole is upright and in an unloaded condition; and the thickness of the shoe sole being defined as the length of a line starting at a starting point on the sole inner surface and extending to the sole outer surface in a direction perpendicular to a line tangent to the sole inner surface at the starting point, as viewed in a shoe sole frontal plane cross-section of the sole heel portion when the shoe sole is upright and in an unloaded condition.

22. The shoe sole as set forth in claim 19, wherein the concavely rounded sole outer surface portion extends from an uppermost portion of the shoe sole side to below a level of the lowest point of the sole inner surface, as viewed in a shoe sole frontal plane cross-section of the sole heel portion when the shoe sole is upright and in an unloaded condition.

23. The shoe sole as set forth in claim 19, wherein the concavely rounded sole outer surface portion extends through a sidemost extent of the shoe sole side, as viewed in a shoe sole frontal plane cross-section of the sole heel portion when the shoe sole is upright and in an unloaded condition.

24. The shoe sole as set forth in claim 19, wherein the concavely rounded sole outer surface portion extends through a lowermost point of the shoe sole side, as viewed in a shoe sole frontal plane cross-section of the sole heel portion when the shoe sole is upright and in an unloaded condition.

25. The shoe sole as set forth in claim 19, wherein each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition.

26. The shoe sole as set forth in claim 25, wherein the thickness of the portion of the midsole which extends into the sidemost section of the at least one shoe sole side having a concavely rounded outer surface portion increases from a first thickness at an uppermost point on the midsole to a greater thickness at a portion of said midsole below said uppermost point, as viewed in a shoe sole frontal plane cross-section of the sole heel portion when the shoe sole is upright and in an unloaded condition; and the thickness of the midsole portion being defined as the length of a line starting at a starting point on the inner surface of the midsole portion and extending to an outer surface of the midsole portion in a direction perpendicular to a line tangent to the inner surface of the midsole portion at the starting point, as viewed in a shoe sole frontal plane cross-section of the sole heel portion when the shoe sole is upright and in an unloaded condition.

27. The shoe sole as set forth in claim 19, wherein the midsole has portions having first, second and third firmnesses, the portion of the midsole having the first firmness is located adjacent to a side edge of the shoe sole and the portion of the midsole having the second firmness is located adjacent to a center line of the shoe sole, all as viewed in the frontal plane cross-section of the sole heel portion when the shoe sole is upright and in an unloaded condition; and the first firmness is firmer than the second firmness during a shoe sole unloaded condition.

28. The shoe sole as set forth in claim 27, wherein the thickness of the side portion of the shoe sole is defined as the length of a line starting at a starting point on the sole inner surface and extending to the sole outer surface in a direction perpendicular to a line tangent to the sole inner surface at the starting point, all as viewed in a shoe sole frontal plane cross-section when the shoe sole is upright and in an unloaded condition.

29. The shoe sole as set forth in claim 19, wherein the midsole comprises portions with first, second and third firmnesses, said portion of first firmness having a lesser firmness than said portion of second firmness, said portion of lesser firmness being located in a heel section of the shoe sole, and said portion of greater firmness being located adjacent to said portion of lesser firmness.

30. The shoe sole as set forth in claim 1, wherein the concavely rounded portion of the sole outer surface extends down to near a lowest point of one of the lateral and medial sides of the shoe sole, as viewed in the shoe sole frontal plane cross-section of the sole heel portion when the shoe sole is upright and in an unloaded condition.

31. The shoe sole as set forth in claim 19, wherein both the sole lateral side and the sole medial side comprise a convexly rounded inner surface portion and a concavely rounded outer surface portion, as viewed in the shoe sole frontal plane cross-section when the shoe sole is upright and in an unloaded condition.

32. The shoe sole as set forth in claim 19, wherein the midsole comprises portions with first and second firmnesses, and one of said midsole portions of first and second firmness has a greater thickness in the side portion than a thickness of the same midsole portion in the sole middle portion, as viewed in the shoe sole frontal plane cross-section when the shoe sole is upright and in an unloaded condition.

33. The shoe sole as set forth in claim 19, wherein the portions of the midsole having three different firmnesses can be viewed in a single frontal plane cross-section when the shoe sole is upright and in an unloaded condition.

34. The shoe sole as set forth in claim 19, wherein a midsole portion of greatest firmness is located adjacent a side edge of the shoe sole, a midsole portion of least firmness is located adjacent a centerline of the shoe sole, and a midsole portion of intermediate firmness is located between the midsole portion of greatest firmness and the midsole portion of least firmness, as viewed in a frontal plane cross-section when the shoe sole is upright and in an unloaded condition.

35. The shoe sole as set forth in claim 34, further comprising a second midsole portion of greatest firmness adjacent a second side edge of the shoe sole and a second midsole portion of intermediate firmness located between the second midsole portion of greatest firmness and the midsole portion of least firmness, as viewed in a frontal plane cross-section when the shoe sole is upright and in an unloaded condition.

36. The shoe sole as set forth in claim 19, wherein a midsole portion of least firmness is located adjacent a centerline of the shoe sole, a midsole portion of greatest firmness is located on a first side of the midsole portion of least firmness, and a midsole portion of intermediate firmness is located on a second side of the midsole portion of least firmness, as viewed in a frontal plane cross-section when the shoe sole is upright and in an unloaded condition.

37. A shoe sole as claimed in claim 36, wherein the midsole portions of intermediate and greatest firmness are also located adjacent to first and second side edges of the shoe sole, as viewed in a frontal plane cross-section when the shoe sole is upright and in an unloaded condition.

38. A sole for an athletic shoe comprising:

a sole outer surface;

a sole inner surface;

a sole forefoot area at a location substantially corresponding to the location of a forefoot of an intended wearer's foot when inside the shoe;

a sole heel area at a location substantially corresponding to the location of a heel of an intended wearer's foot when inside the shoe;

a sole midtarsal area at a location substantially corresponding to the area between the heel and the forefoot of the intended wearer's foot when inside the shoe;

a midsole;

the sole surfaces of the sole for an athletic shoe defining a sole medial side, a sole lateral side, and a sole middle portion between the sole medial and lateral sides, the sole outer surface of one of the lateral and medial sides comprising a concavely rounded portion extending at least below a level of a lowest point of the sole inner surface, as viewed in a shoe sole frontal plane cross-section of the sole heel area when the shoe sole is upright and in an unloaded condition, the concavity of the concavely rounded portion existing with respect to an inner section of the shoe sole directly adjacent to the concavely rounded outer surface portion, the sole inner surface of the side of the shoe sole which has a concavely rounded outer surface portion comprising a convexly rounded portion, as viewed in the shoe sole frontal plane cross-section when the shoe sole is upright and in an unloaded condition, the convexity of the convexly rounded portion existing with respect to a section of the shoe sole directly adjacent to the convexly rounded inner surface portion; and a rounded sole side portion located between the convexly rounded portion of the sole inner surface and the concavely rounded portion of the sole outer surface having a thickness measured from the sole inner surface to the sole outer surface that is greater than a least thickness of the sole middle portion measured from the sole inner surface to the sole outer surface, as viewed in the frontal plane cross-section when the shoe sole is upright and in an unloaded condition;

wherein the midsole comprises midsole portions of first and second densities, said midsole portion of first density having a lesser density than said midsole portion of second density, said area of lesser density being located in a heel area of the shoe sole and said midsole portion of greater density being located adjacent said midsole portion of lesser density; and said midsole portions of first and second density each have a thickness that tapers from a greater thickness to a lesser thickness, as viewed a frontal plane cross-section when the shoe sole is upright and in an unloaded condition.

39. The shoe sole as set forth in claim 38, wherein the first of said midsole portions is located below the second of said midsole portions, as viewed a frontal plane cross-section when the shoe sole is upright and in an unloaded condition.

40. The shoe sole as set forth in claim 38, wherein the at least one shoe sole side having a concavely rounded outer surface portion extends up to a level above the lowest point of the inner surface of the shoe sole, as viewed in a shoe sole frontal plane cross-section of the sole heel portion when the shoe sole is upright and in an unloaded condition.

41. The shoe sole as set forth in claim 38, wherein the thickness of the at least one shoe sole side having a concavely rounded outer surface portion increases from a first thickness at an uppermost point on the shoe sole side to a greater thickness at a portion of said shoe sole side below said uppermost point, as viewed in a shoe sole frontal plane cross-section of the sole heel portion when the shoe sole is upright and in an unloaded condition; and the thickness of the shoe sole being defined as the length of a line starting at a starting point on the sole inner surface and extending to the sole outer surface in a direction perpendicular to a line tangent to the sole inner surface at the starting point, as viewed in a shoe sole frontal plane cross-section of the sole heel portion when the shoe sole is upright and in an unloaded condition.

42. The shoe sole as set forth in claim 41, wherein the concavely rounded sole outer surface portion extends through a sidemost extent of the shoe sole side, as viewed in a shoe sole frontal plane cross-section of the sole heel portion when the shoe sole is upright and in an unloaded condition;

each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition;

the two midsole portions having different densities can be viewed in a single frontal plane cross-section of the sole heel portion when the shoe sole is upright and in an unloaded condition; and the midsole portion having the first density is located adjacent to a side edge of the shoe sole and the midsole portion having the second density is located adjacent to a center line of the shoe sole, as viewed in the frontal plane cross-section of the sole heel portion when the shoe sole is upright and in an unloaded condition.

43. The shoe sole as set forth in claim 38, wherein the concavely rounded sole outer surface portion extends from an uppermost portion of the shoe sole side to below a level of the lowest point of the sole inner surface, as viewed in a shoe sole frontal plane cross-section of the sole heel portion when the shoe sole is upright and in an unloaded condition.

44. The shoe sole as set forth in claim 38, wherein the concavely rounded sole outer surface portion extends through a sidemost extent of the shoe sole side, as viewed in a shoe sole frontal plane cross-section of the sole heel portion when the shoe sole is upright and in an unloaded condition.

45. The shoe sole as set forth in claim 38, wherein the concavely rounded sole outer surface portion extends through a lowermost point of the shoe sole side, as viewed in a shoe sole frontal plane cross-section of the sole heel portion when the shoe sole is upright and in an unloaded condition.

46. The shoe sole as set forth in claim 38, wherein each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition.

47. The shoe sole as set forth in claim 38, wherein the thickness of the portion of the midsole which extends into the sidemost section of the at least one shoe sole side having a concavely rounded outer surface portion increases from a first thickness at an uppermost point on the midsole to a greater thickness at a portion of said midsole below said uppermost point, as viewed in a shoe sole frontal plane cross-section of the sole heel portion when the shoe sole is upright and in an unloaded condition; and the thickness of the midsole portion being defined as the length of a line starting at a starting point on the inner surface of the midsole portion and extending to an outer surface of the midsole portion in a direction perpendicular to a line tangent to the inner surface of the midsole portion at the starting point, as viewed in a shoe sole frontal plane cross-section of the sole heel portion when the shoe sole is upright and in an unloaded condition.

48. The shoe sole as set forth in claim 38, wherein the midsole portion having the first density is located adjacent to a side edge of the shoe sole and the midsole portion having the second density is located adjacent to a center line of the shoe sole, all as viewed in the frontal plane cross-section of the sole heel portion when the shoe sole is upright and in an unloaded condition.

49. The shoe sole as set forth in claim 38, wherein the concavely rounded portion of the sole outer surface extends down to near a lowest point of one of the lateral and medial sides of the shoe sole, as viewed in the shoe sole frontal plane cross-section of the sole heel portion when the shoe sole is upright and in an unloaded condition.

50. The shoe sole as set forth in claim 38, wherein both the sole lateral side and the sole medial side comprise a convexly rounded inner surface portion and a concavely rounded outer surface portion, as viewed in the shoe sole frontal plane cross-section when the shoe sole is upright and in an unloaded condition.

51. The shoe sole as set forth in claim 38, wherein the two midsole portions having different densities can be viewed in a single frontal plane cross-section when the shoe sole is upright and in an unloaded condition.

52. A shoe sole as claimed in claim 38, wherein a first of said midsole portions of first and second density has a thickness that tapers from a greater thickness in the side portion of the shoe sole to a lesser thickness at a location closer to the centerline of the shoe sole, as viewed a frontal plane cross-section when the shoe sole is upright and in an unloaded condition.

53. A shoe sole as claimed in claim 52, wherein a second of said midsole portions of first and second firmness has a thickness that tapers from a lesser thickness in a side portion of the shoe sole to a greater thickness at a location closer to the centerline of the shoe sole, as viewed a frontal plane cross-section when the shoe sole is upright and in an unloaded condition.

54. A sole for an athletic shoe comprising:

a sole outer surface;

a sole inner surface;

a sole forefoot area at a location substantially corresponding to the location of a forefoot of an intended wearer's foot when inside the shoe;

a sole heel area at a location substantially corresponding to the location of a heel of an intended wearer's foot when inside the shoe;

a sole midtarsal area at a location substantially corresponding to the area between the heel and the forefoot of the intended wearer's foot when inside the shoe;

a midsole;

the sole surfaces of the sole for an athletic shoe defining a sole medial side, a sole lateral side, and a sole middle portion between the sole medial and lateral sides, the sole outer surface of one of the lateral and medial sides comprising a concavely rounded portion extending at least below a level of a lowest point of the sole inner surface, as viewed in a shoe sole frontal plane cross-section of the sole heel area when the shoe sole is upright and in an unloaded condition, the concavity of the concavely rounded portion existing with respect to an inner section of the shoe sole directly adjacent to the concavely rounded outer surface portion, the sole inner surface of the side of the shoe sole which has a concavely rounded outer surface portion comprising a convexly rounded portion, as viewed in the shoe sole frontal plane cross-section when the shoe sole is upright and in an unloaded condition, the convexity of the convexly rounded portion existing with respect to a section of the shoe sole directly adjacent to the convexly rounded inner surface portion; and a rounded sole side portion located between the convexly rounded portion of the sole inner surface and the concavely rounded portion of the sole outer surface having a thickness measured from the sole inner surface to the sole outer surface that is greater than a least thickness of the sole middle portion measured from the sole inner surface to the sole outer surface, as viewed in the frontal plane cross-section when the shoe sole is upright and in an unloaded condition;

wherein the midsole comprises midsole portions of first and second firmnesses, said midsole portion of first firmness having a lesser firmness than said midsole portion of second firmness, said area of lesser firmness being located in a heel area of the shoe sole and said midsole portion of greater firmness being located adjacent said midsole portion of lesser firmness; and said midsole portions of first and second firmness each have a thickness that tapers from a greater thickness to a lesser thickness, as viewed a frontal plane cross-section when the shoe sole is upright and in an unloaded condition.

55. The shoe sole as set forth in claim 54, wherein the first of said midsole portions is located below the second of said midsole portions, as viewed a frontal plane cross-section when the shoe sole is upright and in an unloaded condition.

56. The shoe sole as set forth in claim 54, wherein the at least one shoe sole side having a concavely rounded outer surface portion extends up to a level above the lowest point of the inner surface of the shoe sole, as viewed in a shoe sole frontal plane cross-section of the sole heel portion when the shoe sole is upright and in an unloaded condition.

57. The shoe sole as set forth in claim 54, wherein the thickness of the at least one shoe sole side having a concavely rounded outer surface portion increases from a first thickness at an uppermost point on the shoe sole side to a greater thickness at a portion of said shoe sole side below said uppermost point, as viewed in a shoe sole frontal plane cross-section of the sole heel portion when the shoe sole is upright and in an unloaded condition; and the thickness of the shoe sole being defined as the length of a line starting at a starting point on the sole inner surface and extending to the sole outer surface in a direction perpendicular to a line tangent to the sole inner surface at the starting point, as viewed in a shoe sole frontal plane cross-section of the sole heel portion when the shoe sole is upright and in an unloaded condition.

58. The shoe sole as set forth in claim 57, wherein the concavely rounded sole outer surface portion extends through a sidemost extent of the shoe sole side, as viewed in a shoe sole frontal plane cross-section of the sole heel portion when the shoe sole is upright and in an unloaded condition;

each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition;

the two midsole portions having different firmnesses can be viewed in a single frontal plane cross-section of the sole heel portion when the shoe sole is upright and in an unloaded condition; and the midsole portion having the first firmness is located adjacent to a side edge of the shoe sole and the midsole portion having the second firmness is located adjacent to a center line of the shoe sole, as viewed in the frontal plane cross-section of the sole heel portion when the shoe sole is upright and in an unloaded condition.

59. The shoe sole as set forth in claim 54, wherein the concavely rounded sole outer surface portion extends from an uppermost portion of the shoe sole side to below a level of the lowest point of the sole inner surface, as viewed in a shoe sole frontal plane cross-section of the sole heel portion when the shoe sole is upright and in an unloaded condition.

60. The shoe sole as set forth in claim 54, wherein the concavely rounded sole outer surface portion extends through a sidemost extent of the shoe sole side, as viewed in a shoe sole frontal plane cross-section of the sole heel portion when the shoe sole is upright and in an unloaded condition.

61. The shoe sole as set forth in claim 54, wherein the concavely rounded sole outer surface portion extends through a lowermost point of the shoe sole side, as viewed in a shoe sole frontal plane cross-section of the sole heel portion when the shoe sole is upright and in an unloaded condition.

62. The shoe sole as set forth in claim 54, wherein each shoe sole side comprises a sidemost section of the shoe sole located outside of a straight vertical line drawn at the sidemost extent of the inner surface of the midsole and at least a portion of the midsole extends into the sidemost section of the at least one shoe sole side having a concavely rounded outer surface portion, as viewed in a shoe sole frontal plane cross-section of the sole heel portion when the shoe sole is upright and in an unloaded condition.

63. The shoe sole as set forth in claim 54, wherein the thickness of the portion of the midsole which extends into the sidemost section of the at least one shoe sole side having a concavely rounded outer surface portion increases from a first thickness at an uppermost point on the midsole to a greater thickness at a portion of said midsole below said uppermost point, as viewed in a shoe sole frontal plane cross-section of the sole heel portion when the shoe sole is upright and in an unloaded condition; and the thickness of the midsole portion being defined as the length of a line starting at a starting point on the inner surface of the midsole portion and extending to an outer surface of the midsole portion in a direction perpendicular to a line tangent to the inner surface of the midsole portion at the starting point, as viewed in a shoe sole frontal plane cross-section of the sole heel portion when the shoe sole is upright and in an unloaded condition.

64. The shoe sole as set forth in claim 54, wherein the midsole portion having the first firmness is located adjacent to a side edge of the shoe sole and the midsole portion having the second firmness is located adjacent to a center line of the shoe sole, all as viewed in the frontal plane cross-section of the sole heel portion when the shoe sole is upright and in an unloaded condition.

65. The shoe sole as set forth in claim 54, wherein the concavely rounded portion of the sole outer surface extends down to near a lowest point of one of the lateral and medial sides of the shoe sole, as viewed in the shoe sole frontal plane cross-section of the sole heel portion when the shoe sole is upright and in an unloaded condition.

66. The shoe sole as set forth in claim 54, wherein both the sole lateral side and the sole medial side comprise a convexly rounded inner surface portion and a concavely rounded outer surface portion, as viewed in the shoe sole frontal plane cross-section when the shoe sole is upright and in an unloaded condition.

67. The shoe sole as set forth in claim 54, wherein the two midsole portions having different firmnesses can be viewed in a single frontal plane cross-section when the shoe sole is upright and in an unloaded condition.

68. A shoe sole as claimed in claim 54, wherein a first of said midsole portions of first and second firmness has a thickness that tapers from a greater thickness in the side portion of the shoe sole to a lesser thickness at a location closer to the centerline of the shoe sole, as viewed a frontal plane cross-section when the shoe sole is upright and in an unloaded condition.

69. A shoe sole as claimed in claim 68, wherein a second of said midsole portions of first and second firmness has a thickness that tapers from a lesser thickness in a side portion of the shoe sole to a greater thickness at a location closer to the centerline of the shoe sole, as viewed a frontal plane cross-section when the shoe sole is upright and in an unloaded condition.

* * * * *

UNITED STATES PATENT AND TRADEMARK OFFICE

CERTIFICATE OF CORRECTION

PATENT NO. : 6,360,453 B1
DATED : March 26, 2002
INVENTOR(S) : Frampton E. Ellis, III It is certified that error appears in the above-identified patent and that said Letters Patent is hereby corrected as shown below:

Title page,
Item [54], delete the title in its entirety and substitute therefore -- SHOE SOLE STRUCTURE --;

Column 11,
Line 44, replace "claim 11" with -- claim 15 --; and

Column 14,
Line 1, replace "claim 1" with -- claim 19 --.

Signed and Sealed this

Nineteenth Day of November, 2002

*Attest:*

*Attesting Officer*

JAMES E. ROGAN
*Director of the United States Patent and Trademark Office*